US005606958A

United States Patent [19]

Chrintz-Gath et al.

[11] Patent Number: 5,606,958

[45] Date of Patent: Mar. 4, 1997

[54] IGNITION SYSTEM FOR AN INTERNAL-COMBUSTION ENGINE, PARTICULARLY FOR USE IN A CHAIN SAW OR THE LIKE

[75] Inventors: Per-Anders Chrintz-Gath, Västervik; Per J. Udden, Ankarsrum, both of Sweden

[73] Assignee: FHP Elmotor Aktiebolag, Ankarsrum, Sweden

[21] Appl. No.: 495,526

[22] PCT Filed: Nov. 30, 1994

[86] PCT No.: PCT/SE94/01153

§ 371 Date: Jul. 28, 1995

§ 102(e) Date: Jul. 28, 1995

[87] PCT Pub. No.: WO95/15438

PCT Pub. Date: Jun. 8, 1995

[30] Foreign Application Priority Data

Dec. 1, 1993 [SE] Sweden ..... 9303999

[51] Int. Cl.[6] ..... F02P 3/08; F02P 5/145

[52] U.S. Cl. ..... 123/601; 123/631; 123/149 C; 123/602

[58] Field of Search ..... 123/149 C, 149 D, 123/418, 599, 601, 602, 631

[56] References Cited

U.S. PATENT DOCUMENTS

| | | | |
|---|---|---|---|
| 3,598,098 | 8/1971 | Sohner et al. | 123/601 |
| 3,955,549 | 5/1976 | Burson | 123/601 |
| 4,401,096 | 8/1983 | Podrapsky | 123/601 |
| 4,491,121 | 1/1985 | Miura et al. | 123/631 |
| 4,611,570 | 9/1986 | Nash | 123/601 |
| 4,727,851 | 3/1988 | Orova | 123/601 |
| 5,020,506 | 6/1991 | Ozawa | 123/631 |

*Primary Examiner*—Willis R. Wolfe

*Attorney, Agent, or Firm*—Pearne, Gordon, McCoy & Granger

[57] ABSTRACT

Ignition system for an internal-combustion engine, in particular for use in a chain saw or the like, comprising a magnetically conducting core supporting a charging winding and a triggering winding, a flywheel having at least one magnetic field generating member and adapted to cooperate with the magnetically conducting core to cause, when passing, voltages to be induced in the windings, and an electronic switch means adapted to trigger, in response to a trigger pulse generated by the triggering winding, the discharge of a capacitor, which has been charged by a voltage generated in the charging winding, via the primary of an ignition coil the secondary of which comprises a spark plug. The ignition system comprises an additional winding which is provided and disposed so that during its normal rotational movement the flywheel first passes said additional winding before turning in over the legs of the magnetically conducting core, the voltage induced in the additional winding being used to prevent trigger pulses from reaching the switch means if the direction of rotation of the engine is the opposite to the normal one.

5 Claims, 3 Drawing Sheets

IGNITION SYSTEM FOR AN INTERNAL-COMBUSTION ENGINE, PARTICULARLY FOR USE IN A CHAIN SAW OR THE LIKE

BACKGROUND OF THE INVENTION

The present invention relates to an ignition system for an internal-combustion engine, in particular for use in a chain saw or the like, comprising a magnetically conducting core supporting a charging winding and a triggering winding, a flywheel having at least one magnetic field generating member and adapted to cooperate with the magnetically conducting core to cause, when passing, voltages to be induced in the windings, and an electronic switch means adapted to trigger, in response to a trigger pulse generated by the triggering winding, the discharge of a capacitor, which has been charged by a voltage generated in the charging winding, via the primary of an ignition coil the secondary of which comprises a spark plug.

Internal combustion engines for chain saws and the like often operate at very high speeds, for example up to 14,000 rpm. This means that the ignition system of the engine has to be designed so as to have a large ignition advance in order for the engine to operate properly. At the same time the ignition advance must not be too large when the engine is to be started-up. If the ignition advance is too large at start it can easily happen that reverse motion takes place which may cause injury to the person handling, for instance, a chain saw.

Moreover, internal combustion engines of today are designed to have a high power output which often means high compression in the motor. When such a motor is to be started by pulling a start strap or the like the high compression will have a braking influence on the movement of the piston and the starting course becomes restless. In addition to backstroke it can happen that the engine starts rotating in the reverse direction which is inacceptable and has to be prevented. This course may also take place when the chain saw passes over from a condition of no-load to a condition of heavy load with the accompanying strong drop in engine speed.

One solution to the problem is to design the engine with a particular extended range of ignition advance permitting the required large ignition advance at operating speed and at the same time offering the possibility of late ignition at start where the ignition spark shall appear at a moment corresponding to one or a few degrees before the upper dead center. Such a solution is described in PCT/SE94/01152.

Another way of ensuring that the engine rotates in the correct direction is described in U.S. Pat. No. 5,050,553. In this publication there is described a microprocessor-controlled capacitive ignition system for internal combustion engines, in particular lawn mowers, chain saws end the like, in which the direction of rotation of the engine is sensed by means of a sensor counting the number of positive and/or negative half periods appearing in a charging winding in the magnetic circuit of the ignition system when the winding is influenced by a passing magnetic field generating member mounted on the flywheel of the engine.

The device described in the publication and used for sensing of the direction of rotation of the engine presupposes that the ignition system includes a microprocessor which involves additional cost for the product of a magnitude which often makes it desirable to find a simpler solution to the problem.

SUMMARY OF THE INVENTION

Accordingly, an object of the invention is to provide a device which, by use of simple means, makes it possible to determine the direction of rotation of an internal combustion engine and to prevent trigger pulses from being put through to the electronic switch in case of wrong direction of rotation of the engine.

In accordance with the present invention, an ignition system has an additional winding which is disposed so that, during its normal rotational movement, the flywheel first passes the additional winding before turning in over the legs of the magnetically conducting core. The voltage induced in the additional winding is used to prevent trigger pulses from reaching the switch means if the direction of rotation of the engine is opposite to the normal one.

BRIEF DESCRIPTION OF THE DRAWINGS

The invention will now be described more in detail in connection with an embodiment with reference to the enclosed drawings, in which.

DETAILED DESCRIPTION OF THE PREFERRED EMBODIMENTS

Figure 1:
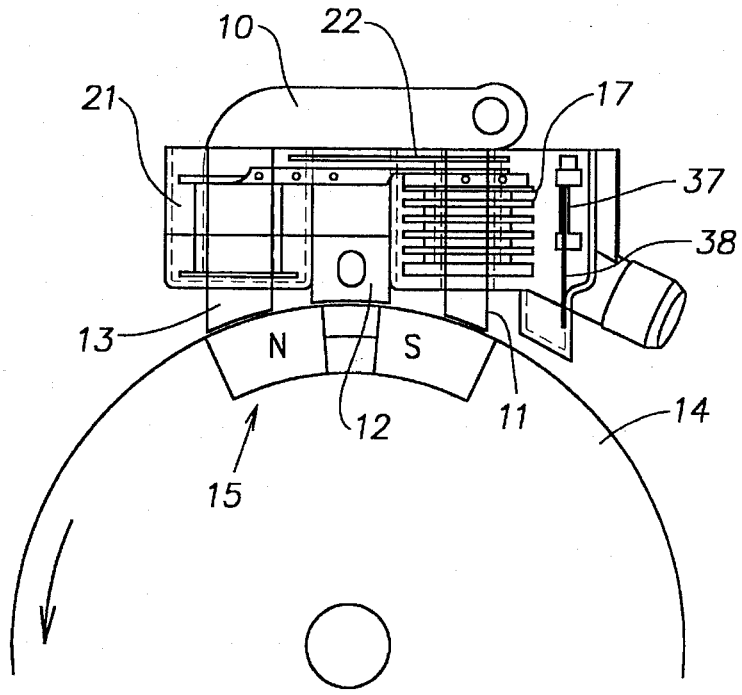
FIG. 1 shows a schematic view of the ignition system according to the invention, seen in a direction perpendicular to a flywheel rotating in the plane of the drawing.

In FIG. 1 there is shown the mechanical structure of a magnetic type ignition system according to the invention. The ignition system is adapted to be used in a two-stroke internal combustion engine for a chain saw. The engine is of a type commonly used and will not be described in further detail. The system comprises a magnetically conducting iron core 10 provided with three legs 11, 12, 13. In a suitable way, the core is mounted on the chain saw to cooperate with a magnetic field generating device 15 fixed to the flywheel 14 on the engine and having the shape of a permanent magnet provided with a north pole and a south pole marked by N and S, respectively.

Figure 2:
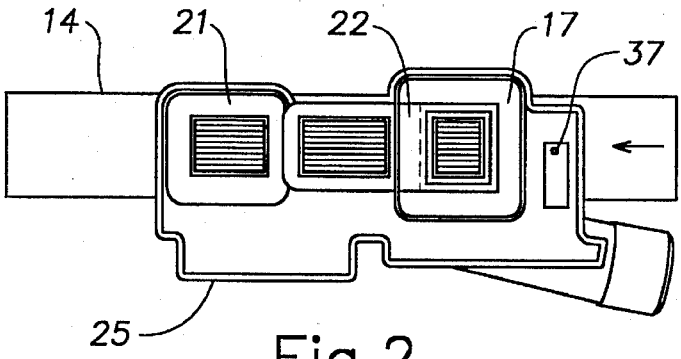
FIG. 2 shows a section of the ignition system of FIG. 1, seen from above.
Figure 3:
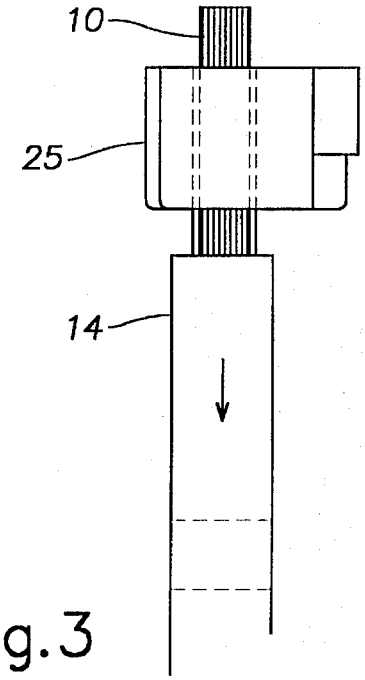
FIG. 3 shows the ignition system of FIG. 1 from the left side.
Figure 4:
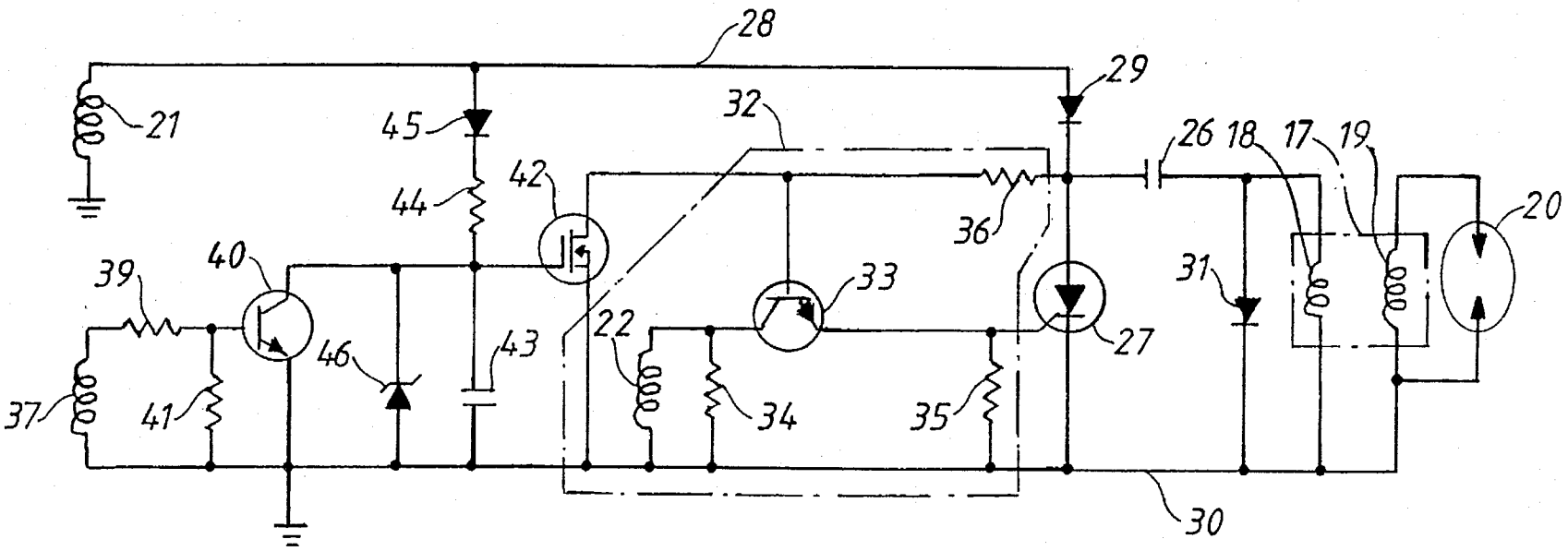
FIG. 4 shows an electric circuit diagram for the ignition system.

The flywheel 14 rotates in the direction indicated by an arrow in the figure. On its leg 11 the iron core 10 supports an ignition coil 17, comprising a primary 18 and a secondary 19 (FIG. 4). A spark plug 20 is connected to the secondary, schematically illustrated in FIG. 4. In addition, on its leg 13 the iron core 10 supports a charging winding 21 the induced voltage of which is intended for charging a capacitor for the purpose of storing ignition energy. Moreover, a triggering winding 22 is wound about the legs 11 and 12 which is intended for triggering of an electronic switch. The disposition of the different windings clearly appears in FIGS. 1–3. The ignition coil 17, the triggering winding 22 and the charging winding 21 are mounted on bobbins disposed in a plastic cup 25 provided with suitable holes for the legs of the iron core. The plastic 25 cup is also adapted to contain a printed circuit board supporting the electronic components of the ignition system. After the components have been mounted the plastic cup is filled with resin or the like for protection against moisture and other external influence.

The continued description will take place in connection with an electric circuit diagram, shown in FIG. 4, for an ignition system according to the invention. The main components of the system comprise the windings on the iron core referred to above, viz. the charging winding 21 and the triggering winding 22, a charging capacitor 26, the ignition coil 17 with the primary 18 and the secondary 19, the spark plug 20 connected to the secondary 19, and an electronic switch in the shape of a thyristor 27. Via a conductor 28 and a diode 29 the charging winding 21 is connected to one terminal of the capacitor 26 while the other terminal of the capacitor, via the primary 18 of the ignition coil, is connected to a common connecting point represented by a conductor 30 having the reference potential zero or ground. The primary 18 is connected in parallel with a diode 31 having its direction of conduction towards the conductor 30.

In the usual way the thyristor 27 has its anode connected to the charging capacitor 26 and its cathode connected to the common reference point, i.a. the conductor 30. The thyristor has a trigger circuit 32 mainly constituted by the triggering winding 22 and the collector-emitter path of a transistor 33. Accordingly, the collector of the transistor is connected to the triggering winding 22, connected in parallel to a resistor 34, whereas the emitter of the transistor is connected to the control electrode of the thyristor. Further, said emitter is connected to the conductor 30 via a resistor 35. Finally, via a resistor 36, the base of the transistor is connected to the junction between the diode 29, the charging capacitor 26 and the anode of the thyristor 27.

Figure 5:
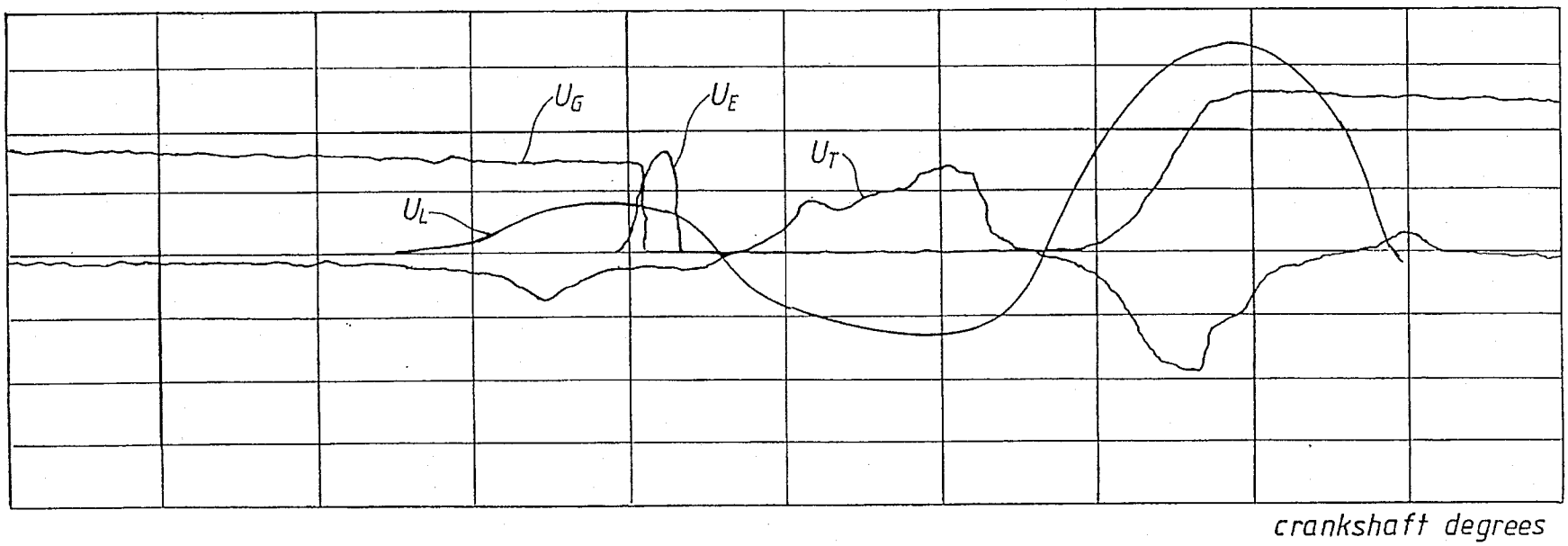
FIG. 5 is a curve chart for voltages appearing in the ignition system.

The ignition system according to the embodiment of FIG. 4 operates in the following way. Reference is also made to FIG. 5 showing the waveforms for different voltages appearing in the ignition system. When the flywheel 14 with its magnet 15 passes the iron core 10 voltages are generated in the charging winding 21 and in the triggering winding 22, respectively, having the waveforms shown in FIG. 5. When the voltage $U_L$ in the charging winding has a positive polarity charging current flows via the conductor 28 and the diode 29 to the capacitor 26 causing the latter to be charged. In FIG. 5 one can see that during a full revolution of the flywheel 14 the charging voltage $U_L$ has two periods in which charging current flows of which the latter of the two periods gives the most important contribution of charge to the capacitor. During operation of the engine, normally, discharge of the capacitor 26 takes place between the charging periods mentioned so that after the first turn, at start, the capacitor during the second period has already been charged to such a high voltage that any additional charge is not being supplied during the following first period with positive charging voltage. In the continued discussion it is assumed that the capacitor 26 has been charged and that the flywheel 14 is at the beginning of a new passage of the iron core 10. Initially, the voltage $U_T$ in the triggering winding has a negative lapse but then rises, ideally seen, linearly towards a peak value after which it falls to zero and passes on to another negative lapse. In the diagram one can see that the voltages $U_L$ and $U_T$ in the charging winding and in the triggering winding, respectively, appear in anti-phase.

For the triggering of the thyristor 27 the rising part of the triggering voltage is of interest. When the voltage has been rising to a certain level it causes current to flow through the transistor 33 and the resistor 35 resulting in the thyristor 27 being ignited. As a result the capacitor 26 is discharged via the thyristor and the primary 18. In the usual way this causes a high voltage to be generated in the secondary 19 and this high voltage causes a spark in the spark plug 20.

In order to prevent triggering of the thyristor 27 when the engine rotates in the wrong direction, in accordance with the invention an additional winding 37 has been provided adjacent to the iron core 10 so that when the flywheel 14 rotates in the direction of the arrow in FIG. 1 (the normal direction of rotation of the engine) the magnet 15 on the flywheel passes the winding 37 before reaching the other windings on the iron core 10. The winding 37 is mounted on a rod-shaped core 38 of a circular cross-section and of small dimensions, for example having a diameter of 0,5 mm. As shown in FIG. 1 the core 38 is fixed in the plastic cup 25 so as to be directed vertically in the figure. In the following, due to its function, the additional winding 37 will be referred to as the enable coil.

As appears from FIG. 4 the enable coil 37 is connected to the base of a transistor 40 via a resistor 39. Further, via a resistor 41, said base is connected to the conductor 30 to which is also connected the opposite end of the enable coil. The collector of the transistor 40 is directly connected to the control electrode of a field effect transistor 42, said control electrode being further connected to the conductor 30 via a capacitor 43 and to the conductor 28 via a resistor 44 and a diode 45. In order for the voltage on the capacitor 43 to be kept at a desired level a zener diode 46 is connected in parallel with the capacitor. The source-electrode of the field effect transistor 42 is connected directly to the conductor 30 whereas the drain-electrode of the field effect transistor is connected to the base of the transistor 33.

The thus completed circuit of FIG. 4 functions in the following way. During the rotation of the flywheel 14 in the direction of the arrow in FIG. 1 the magnet 15 will first pass the enable coil 37 inducing a short voltage pulse therein which appears across the base-emitter path in the transistor 40. The voltage pulse is shown in FIG. 5 and has been designated $U_E$. As in the functional description given above it is assumed that the flywheel has rotated one turn so that the capacitor 26 has been charged from the charging winding 21 as has the capacitor 43 via the resistor 44 and the diode 45. When the voltage pulse appears the transistor 40 will be put into a conductive state and the capacitor 43 be discharged therethrough resulting in that the voltage on the capacitor 43 assumes the reference potential on the conductor 30, i.a. zero volts. When the voltage on the control electrode of the field effect transistor 42 goes low the transistor switches from conducting to non-conducting state resulting in a possibility for transistor 33 to start conducting. The voltage induced in the triggering winding 22 can then pass through the transistor 33 to the control electrode of the thyristor 27 to turn it on so that an ignition spark is generated by the ignition coil.

Following the course of the charging voltage $U_L$ in FIG. 5 one can see that after the appearance of the enable voltage $U_E$ the charging voltage $U_L$ has a negative lapse which after a certain time passes over into a positive lapse where the main charge is supplied to the capacitors 26 and 43. The voltage on the capacitor 43, designated $U_G$ in the diagram of FIG. 5, is low till the charging voltage $U_L$ has again a positive lapse in which the capacitor 43 starts recharging. When the voltage on the capacitor 43 has increased to a certain level the field effect transistor 42 turns into conducting state pulling down the potential on the base of the transistor 33 to that prevailing on the conductor 30, i.a. zero volts. As a result the transistor 33 will be blocked and thereafter any voltage possibly induced in the triggering winding cannot pass the transistor 33 generating faulty trigger pulses. In FIG. 5 it appears that the voltage across the capacitor 43 has a course forming a window where the voltage is low (zero volts) and where triggering can take place. In that connection, arrangements have been made so that the useful part of the triggering voltage $U_T$ has a course falling right into said window. Accordingly, when the engine rotates in the correct direction triggering pulses will be let through the transistor 33 generating ignition sparks as desired.

If for any reason the engine should rotate in the opposite direction to the normal one the windings 21 and 22 will be passed before the enable coil 37 is reached by the magnet 15. In this case the voltage pulse $U_E$ from the enable coil will be negative. Hence, the transistor 40 will not conduct and the capacitor 43 cannot be discharged therethrough. The voltage across the capacitor 43 keeps the field effect transistor 42 conducting which means that the transistor 33 is blocked when voltage is induced in the triggering winding 22. Accordingly, in this case any trigger pulses will not be let through to the control electrode of the thyristor 27.

In FIG. 5 one can see that the triggering voltage $U_T$ has another time period where it is positive, referred to as the tail of the triggering voltage. However, this tail appears at a moment outside the window and cannot cause any faulty triggering of the the thyristor. In the figure the level of the tail is low but will increase as the engine speed increases and at high speeds the tail can give cause to faulty triggering of the thyristor 27 in case the enable coil 37 and associated components should be omitted.

We claim:

1. Ignition system for an internal-combustion engine, comprising a magnetically conducting core (10) supporting a charging winding (21) and a triggering winding (22), a flywheel (14) having at least one magnetic field generating member (15) and adapted to cooperate with the magnetically conducting core (10) to cause, when passing, voltages to be induced in the windings (21, 22), and an electronic switch means (27) adapted to trigger, in response to a trigger pulse generated by the triggering winding (22), discharge of a charging capacitor (26), which has been charged by a voltage generated in the charging winding (21), via a primary (18) of an ignition coil (17), the secondary (19) of said ignition coil including a spark plug (20), wherein an additional winding (37) is provided and disposed so that during normal rotational movement of the flywheel, said flywheel (14) first passes said additional winding (37) before turning in over the legs (11, 12, 13) of the magnetically conducting core (10), the voltage induced in the additional winding (37) being used to prevent trigger pulses from reaching the switch means (27) if a direction of rotation of the engine is opposite to the normal direction, said switch means being a thyristor (27) having a trigger circuit (32) comprising a first transistor (33), the additional winding (37) being connected to the first transistor (33) such that the first transistor forms a blockage between the triggering winding (22) and the control electrode of the thyristor (27) when there is no induced voltage in said additional winding (37), said additional winding (37) being connected to the first transistor (33) via a circuit such that the voltage induced in the additional winding (37) activates an electronic switch (42) to assume a state in which the blocking effect of the first transistor (33) is discontinued for a period of time which is independent of the presence of induced voltage in the additional winding (37).

2. Ignition system according to claim 1, wherein the circuit provided between the additional winding (37) and the first transistor (33) comprises a field effect transistor (42), a control electrode of said field effect transistor (42) being connected to a second capacitor (43) adapted to be charged, via a resistor (44), by a voltage induced in the charging winding (21), an opposite terminal of the second capacitor being connected to a common reference point (30) constituting a common reference potential for the ignition system, the second capacitor (43) being bridged by the collector-emitter path of a second transistor (40) provided to short-circuit the second capacitor (43) to effect discharge thereof upon the presence of induced voltage in the additional winding (37).

3. Ignition system according to claim 2, wherein the control electrode of the thyristor (27) is connected to the triggering winding (22) via the emitter-collector path of the first transistor (33), the base of said first transistor (33) is connected to the common connecting point (30) via the field effect transistor (42) in order to assume the common reference potential and, hence, its blocking state, when the field effect transistor (42) is conducting.

4. Ignition system according to claim 3, wherein via a resistor (36), the base of the first transistor (33) is connected to the anode of the thyristor and to the charging capacitor (26) provided to supply energy to the ignition coil (17) upon discharge through the thyristor (27), a junction between the resistor (36), the charging capacitor (26) and the anode of the thyristor being connected to the charging winding (21) via a diode (29).

5. Ignition system according to any one of the preceding claims, wherein the magnetically conducting core (10) comprises at least three legs (11, 12, 13), the triggering winding (22) being wound about a first two of said at least three legs, as seen in the normal direction of rotation of the flywheel (14), while a third of said at least three legs supports the charging winding (21).

* * * * *